US006237871B1

(12) United States Patent
Morand et al.

(10) Patent No.: US 6,237,871 B1
(45) Date of Patent: May 29, 2001

(54) PAPER TOWEL TRANSFER APPARATUS

(75) Inventors: Michel Morand, Montreal (CA); Patrick C. Perrin, Rancho Palos Verdes; Arthur Van De Brake, San Dimas, both of CA (US)

(73) Assignee: Perrin Manufacturing Company, City of Industry, CA (US)

( * ) Notice: Subject to any disclaimer, the term of this patent is extended or adjusted under 35 U.S.C. 154(b) by 0 days.

(21) Appl. No.: 09/371,771

(22) Filed: Aug. 10, 1999

Related U.S. Application Data

(63) Continuation-in-part of application No. 09/164,440, filed on Sep. 30, 1998, now Pat. No. 5,979,822.

(51) Int. Cl.[7] ..... B65H 16/10

(52) U.S. Cl. ..... 242/564.2; 242/560; 242/564.1; 242/564.4; 242/596.8; 312/34.19; 312/34.22

(58) Field of Search ..... 242/564.2, 560, 242/564.1, 596.8, 564.4; 312/34.19, 34.22, 34.8

(56) References Cited

U.S. PATENT DOCUMENTS

| | | | |
|---|---|---|---|
| 1,025,312 | | 5/1912 | Rydquist . |
| 1,026,128 | | 5/1912 | Rydquist . |
| 1,084,598 | | 1/1914 | Antone . |
| 1,860,668 | | 5/1932 | Gillet . |
| 2,169,399 | | 8/1939 | Steiner . |
| 2,930,664 | | 3/1960 | Liebisch . |
| 2,957,636 | | 10/1960 | LeSavoy . |
| 3,107,957 | | 10/1963 | Batlas et al. . |
| 3,140,060 | | 7/1964 | Layton et al. . |
| 3,628,743 | | 12/1971 | Bastian . |
| 3,672,552 | | 6/1972 | Krueger et al. . |
| 4,192,442 | | 3/1980 | Bastian . |
| 4,699,304 | | 10/1987 | Voss et al. . |
| 4,756,485 | | 7/1988 | Bastian . |
| 4,846,412 | | 7/1989 | Morand . |
| 5,294,192 | | 3/1994 | Omdoll et al. . |
| 5,979,822 | * | 11/1999 | Morand et al. ..... 242/564.2 |
| 6,105,898 | * | 8/2000 | Byrd et al. ..... 242/564.1 |

FOREIGN PATENT DOCUMENTS

| | | |
|---|---|---|
| 794825 | 5/1958 | (GB) . |
| 1114891 | 5/1968 | (GB) . |

* cited by examiner

*Primary Examiner*—Donald P. Walsh
*Assistant Examiner*—Minh-Chau Pham
(74) *Attorney, Agent, or Firm*—Thomas R. Lampe

(57) ABSTRACT

Apparatus for dispensing sheet material from a roll of sheet material includes a rotatable sheet material engagement member having an outer surface for engaging the sheet material. A pivoted shaft is mounted adjacent to the sheet material engagement member having a feed roller mounted thereon. The shaft and feed roller are pivotally moved toward the sheet material engagement member and the feed roller is rotated to transport the sheet material over the outer surface of the sheet material engagement member. Spaced tucker members are connected to the sheet material engagement member and simultaneously rotate and pivot upon depletion of a primary roll of sheet material to position the lead end of a reserve roll between the sheet material engagement member and the feed roller.

39 Claims, 9 Drawing Sheets

PAPER TOWEL TRANSFER APPARATUS

This application is a continuation-in-part of U.S. patent application Ser. No. 09/164,440, filed Sep. 30, 1998, now U.S. Pat. No. 5,979,822.

TECHNICAL FIELD

This invention relates to apparatus for dispensing sheet material from a roll of sheet material. The invention is particularly applicable to the dispensing of paper toweling and the apparatus provides for the automatic transfer from a depleted towel roll to a reserve roll.

BACKGROUND OF THE INVENTION

A great many systems have been devised over the years for dispensing paper toweling from rolls thereof. Many of these systems employ rotatable feed rollers which engage the toweling and direct the toweling to a position exterior of a cabinet or housing for delivery to the consumer. A wide variety of mechanisms have been devised to cause and control rotation of the feed roller as well as severance of the individual towel sheets from the toweling unwound from the roll.

With respect to feed roller actuation and rotation, the use of one-way clutch mechanisms is not uncommon, such mechanisms being utilized to ensure rotation of feed rollers in only one direction of rotation upon actuation of the dispenser mechanism by the consumer. The purpose of such mechanism is, of course, to ensure that the feed roller will only operate to feed the toweling out of the housing and not back toward the supply roll. One-way clutches, while effective for their intended purpose, can add considerably to the cost of paper towel dispensers.

U.S. Pat. No. 4,192,442, issued Mar. 1, 1980, discloses an approach aimed at elimination of a conventional one-way clutch in the form of a floating or displaceable gear which is operable to disengage the actuator structure from the feed roller structure of a paper towel dispenser after a consumer has caused delivery of a towel to dispensing position.

Our co-pending U.S. patent application Ser. No. 09/164,440 is directed to apparatus which utilizes a relatively inexpensive structural arrangement as a substitute for conventional one-way clutch mechanisms to efficiently, reliably and effectively dispense sheet material from a roll of sheet material through use of a rotatable sheet material feed roller. Furthermore, the invention encompasses a unique approach for automatically introducing the lead end of sheet material such as paper toweling into the transport or feed mechanism (including the rotatable feed roller) responsive to depletion of another roll.

The apparatus of the above-referenced co-pending application includes a housing defining an interior for accommodating a roll of sheet material and additionally defining a sheet material outlet communicating with the interior.

A rotatable sheet material engagement member is provided for engaging sheet material unwound from a roll of sheet material within the housing interior.

The apparatus also includes sheet material feed means positioned adjacent to the rotatable sheet material engagement member including a rotatable sheet material feed roller and a support member supporting the sheet material feed roller.

The support member is pivotally mounted relative to the housing to selectively alternatively move the sheet material feed roller toward or away from the rotatable sheet material engagement member.

Means is incorporated in the apparatus for rotating the sheet material feed roller to transport sheet material engaged by the rotatable sheet material engagement member toward the sheet material outlet after the sheet material feed roller has moved toward the rotatable sheet material engagement member.

A single tucker member is connected to the rotatable sheet material engagement member, the tucker member responsive to rotational movement of the rotatable sheet material engagement member to move toward a location between the sheet material feed roller and the rotatable sheet material engagement member to tuck the lead end of a roll of sheet material between the sheet material feed roller and the rotatable sheet material engagement member. The tucker member is elongated and of unitary construction, extending from one side of the housing to the other side thereof. This form of tucker member has been found to have some deficiencies. For example, there can be interference with loading rolls in the dispenser. Furthermore, the elongated tucker member is somewhat susceptible to breakage because it extends the length of the rotatable sheet material engagement member. These and other problems are remedied by the present invention.

Numerous other systems have been devised over the years for effecting transfer between a roll being depleted during paper towel dispensing to a reserve roll. The following patents disclose dispensers which are considered to be representative of the state of the prior art in the field of the present invention: U.S. Pat. No. 3,628,743, issued Dec. 21, 1971, U.S. Pat. No. 4,192,442, issued Mar. 11, 1980, U.S. Pat. No. 3,672,552, issued Jun. 27, 1972, U.S. Pat. No. 4,846,412, issued Jul. 11, 1989, U.S. Pat. No. 5,294,192, issued Mar. 15, 1994, U.S. Pat. No. 1,025,312, issued May 7, 1912, U.S. Pat. No. 1,026,128, issued May 14, 1912, U.S. Pat. No. 1,084,598, issued Jan. 20, 1914, U.S. Pat. No. 1,860,668, issued May 31, 1932, U.S. Pat. No. 2,169,399, issued Aug. 15, 1939, U.S. Pat. No. 2,930,664, issued Mar. 29, 1960, U.S. Pat. No. 2,957,636, issued Oct. 25, 1960, U.S. Pat. No. 3,107,957, issued Oct. 22, 1963, U.S. Pat. No. 3,140,060, issued Jul. 7, 1964, U.S. Pat. No. 4,699,304, issued Oct. 13, 1987, U.S. Pat. No. 4,756,485, issued Jul. 12, 1988, British Patent Specification No. 794,825, Published May 14, 1958, British Patent Specification No. 1,114,891, Published Mar. 11, 1965.

Such patents do not disclose the invention described and claimed herein.

DISCLOSURE OF INVENTION

The apparatus disclosed and claimed herein represents an improvement of the system of our co-pending U.S. patent application Ser. No. 09/164,440, particularly with regard to roll transfer. More particularly, a pair of tucker members are employed in the arrangement of the present invention and the tucker members are readily installed even after the dispenser has been assembled. The dispenser can be shipped without any transfer device to save cost and allow addition of the transfer mechanism at a later time.

In addition, the arrangement disclosed herein loads much more readily. In the prior arrangement, the elongated tucker element or bar can get in the way when the user is trying to load a full roll. In addition, the tucker disclosed in our co-pending application, due to its length, was more susceptible to breakage. The present arrangement is highly reliable and not prone to damage. In addition, in the former arrangement springs were connected to the tucker member or bar to enable it to work satisfactorily. These springs were positioned where they could be inadvertently hit and damaged. Also, some difficulties were presented by the fact that proper loading of and positioning of paper was not obvious and the procedure could be difficult to teach. While springs are employed in the arrangement disclosed and claimed herein, they are out of the way and not prone to inadvertent contact. Assembly is simplified and assembly costs are lowered.

The apparatus of the present invention is for dispensing sheet material, such as paper toweling, from a roll of sheet material.

The apparatus includes a housing defining an interior for accommodating a roll of sheet material and additionally defining a sheet material outlet communicating with the interior.

The apparatus also includes a double-ended rotatable sheet material engagement member having an outer surface for engaging sheet material unwound from a roll of sheet material within the housing interior.

The sheet material feed means is positioned adjacent to the rotatable sheet material engagement member and includes a rotatable sheet material feed roller and a support member supporting the sheet material feed roller. The support member is pivotally mounted relative to the housing to selectively alternatively move the sheet material feed roller toward or away from the rotatable sheet material engagement member.

Means is provided for rotating the sheet material feed roller to transport sheet material engaged by the rotatable sheet material engagement member and by the sheet material feed roller toward the sheet material outlet after the sheet material feed roller has moved toward the rotatable sheet material engagement member.

A pair of tucker members is connected to the rotatable sheet material engagement member. One of the tucker members is located at one end of the rotatable sheet material engagement member and the other of the tucker members is located at the other end of the rotatable sheet material engagement member.

The tucker members are spaced from one another and define a space therebetween. The tucker members are responsive to rotational movement of the rotatable sheet material engagement member to move toward a location between the sheet material feed roller and the rotatable sheet material engagement member to tuck the lead end of a roll of sheet material between the sheet material feed roller and the rotatable sheet material engagement member.

Other features, advantages, and objects of the present invention will become apparent with reference to the following description and accompanying drawings.

PREFERRED MODE FOR CARRYING OUT THE INVENTION

Figure 1:
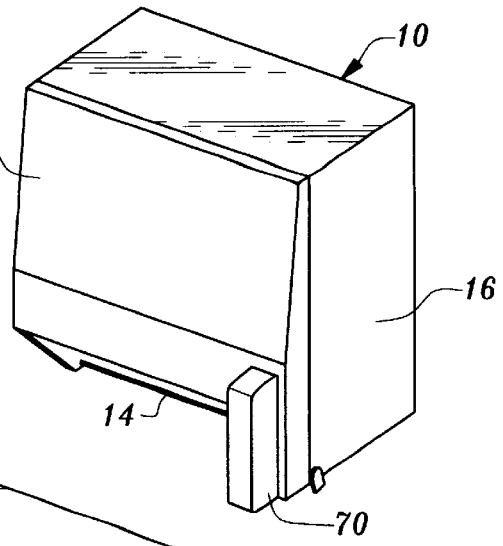
FIG. 1 is a frontal, perspective view of dispenser apparatus incorporating the teachings of the present invention.
Figure 2:
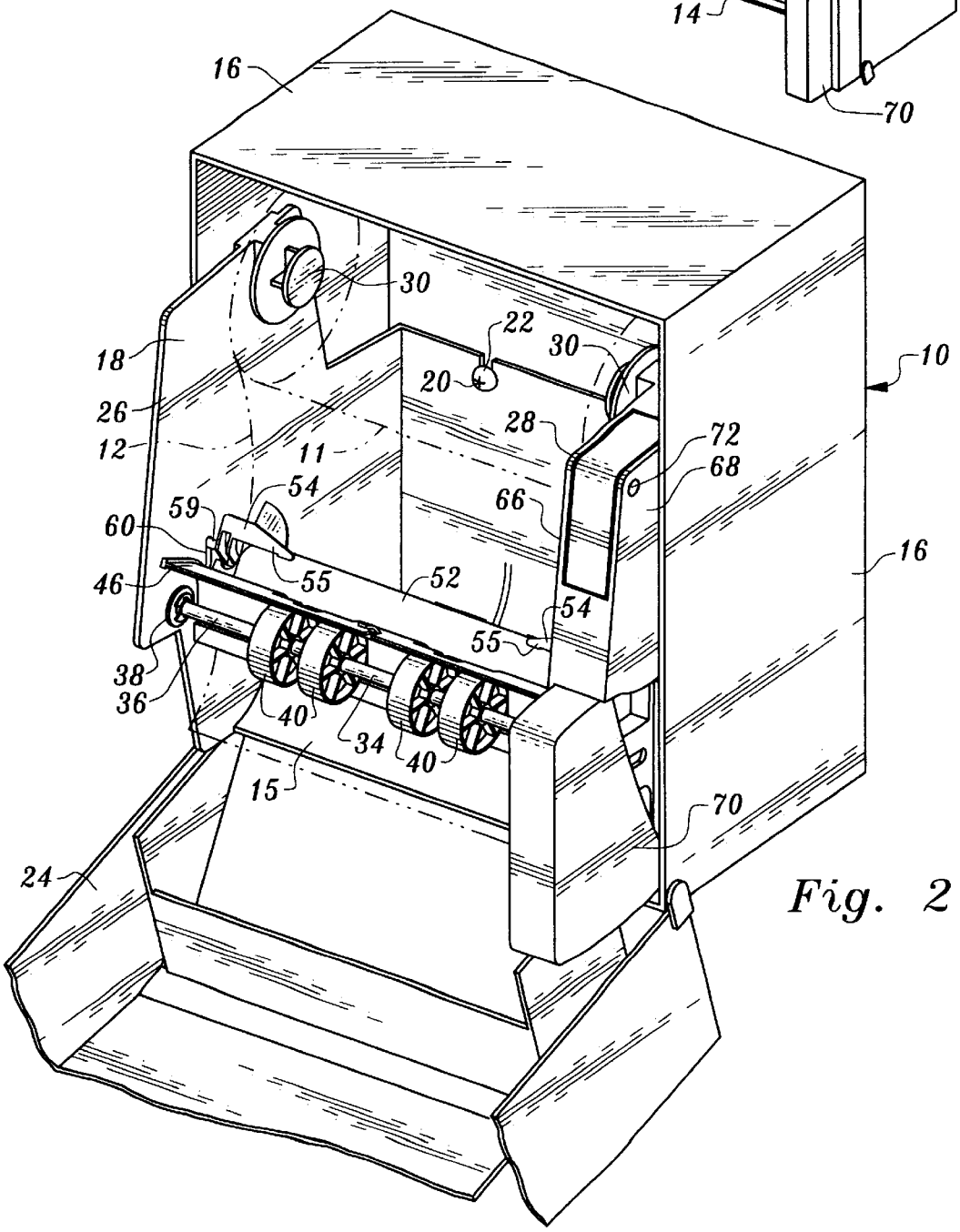
FIG. 2 is an enlarged, frontal, perspective view of the apparatus with the front cover of the dispenser opened to show the housing interior and components of the apparatus.
Figure 3:
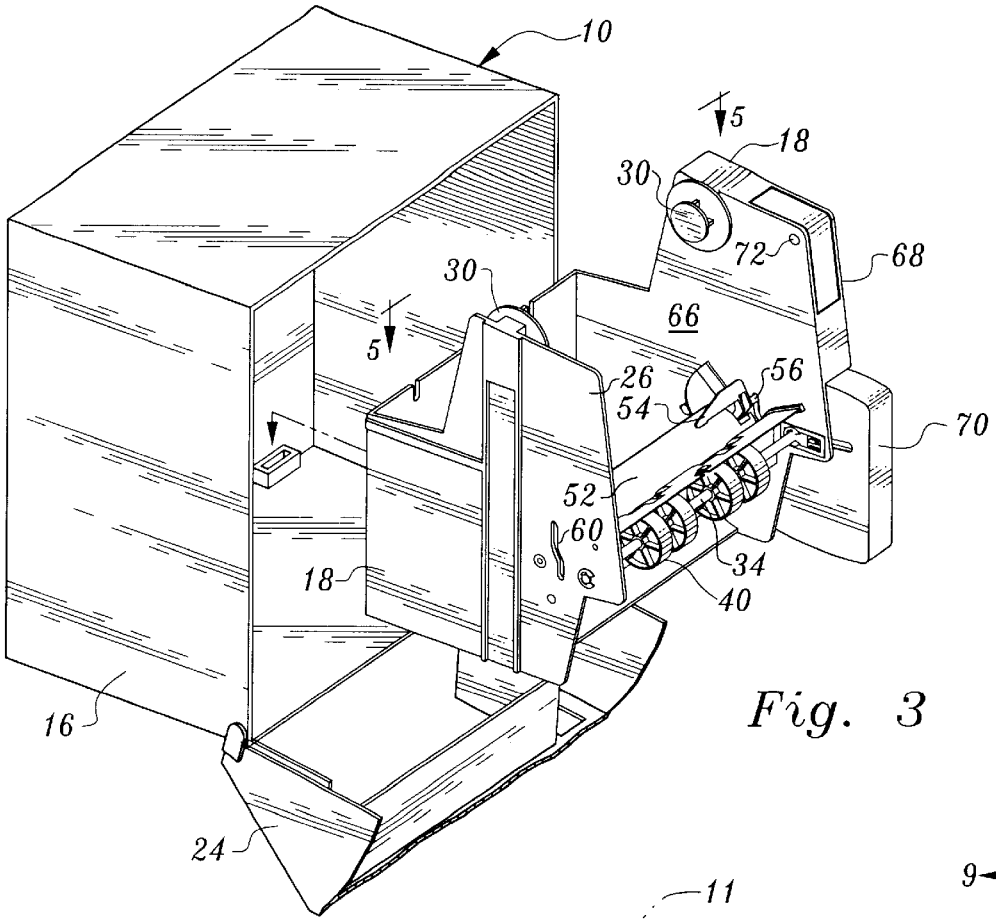
FIG. 3 is an exploded perspective view illustrating an inner housing segment and associated structure being positioned into an outer housing segment of the dispenser apparatus housing.
Figure 4:
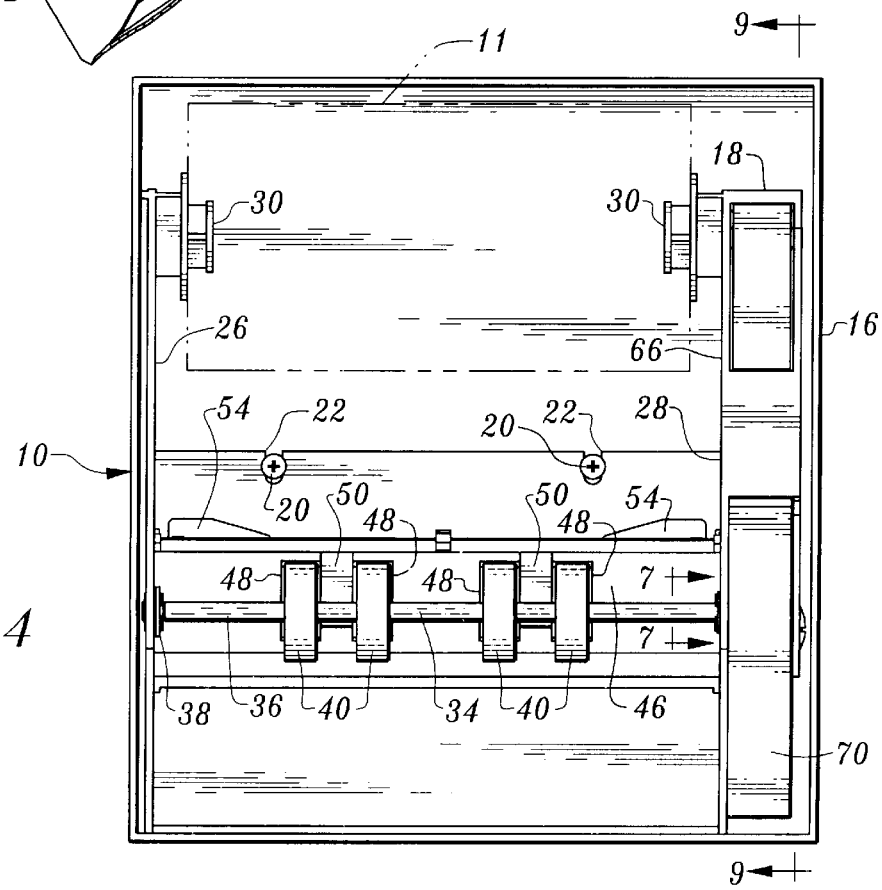
FIG. 4 is a front elevational view of the apparatus as seen through the open front of the housing.

Referring now to the drawings, apparatus constructed in accordance with the teachings of the present invention is illustrated.

The apparatus includes a housing 10 defining an interior for accommodating a roll of sheet material in the form of a roll 11 of paper toweling 12. The housing has an outlet 14 communicating with the housing interior. A curved plate 15 leads to outlet 14.

In the arrangement illustrated, the housing includes an outer housing segment 16 and an inner housing segment 18. These housing segments may be releasably connected together by any suitable means such as threaded fasteners 20 on the outer housing segment received in recesses 22 of the inner housing segment. The disclosed arrangement allows ready connection and disconnection of the housing segments. Outer housing segment 16 includes a hingedly mounted cover 24.

Inner housing segment 18 includes side walls 26, 28. Attached to these side walls are projections 30 which are insertable into the ends of a paper towel roll and allow rotation thereof.

An elongated shaft 34 extends between side walls 26, 28, said shaft including an end 36 which is pivotally connected to side wall 26 by a pivoted socket 38 receiving end 36.

Attached to shaft 34 and extending thereabout are spaced sheet material feed roller segments 40. As will be seen below, these feed roller segments are for the purpose of frictionally engaging paper toweling in contact therewith to transport the toweling toward outlet 14. The feed roller segments have outer surfaces which preferably have a relatively high coefficient of friction. For example, the outer peripheral portions of the feed roller segments may be formed from soft rubber or plastic material having a rough, irregular or non-smooth outer surface. In the arrangement illustrated, a curved guide plate 46 is affixed to the inner housing segment adjacent to the feed roller segments defining openings 48 through which the feed roller segments project. Spring members 50 extend downwardly from the guide plate at spaced locations thereon.

A sheet material engagement member 52 is rotatably mounted on the side walls 26, 28 adjacent and generally parallel to shaft 34 and the feed roller segments 40. The curved outer surface of the member 52, which may for example be formed of hard molded plastic material, is smooth and has a coefficient of friction less than that of the feed roller segments.

Figure 5:
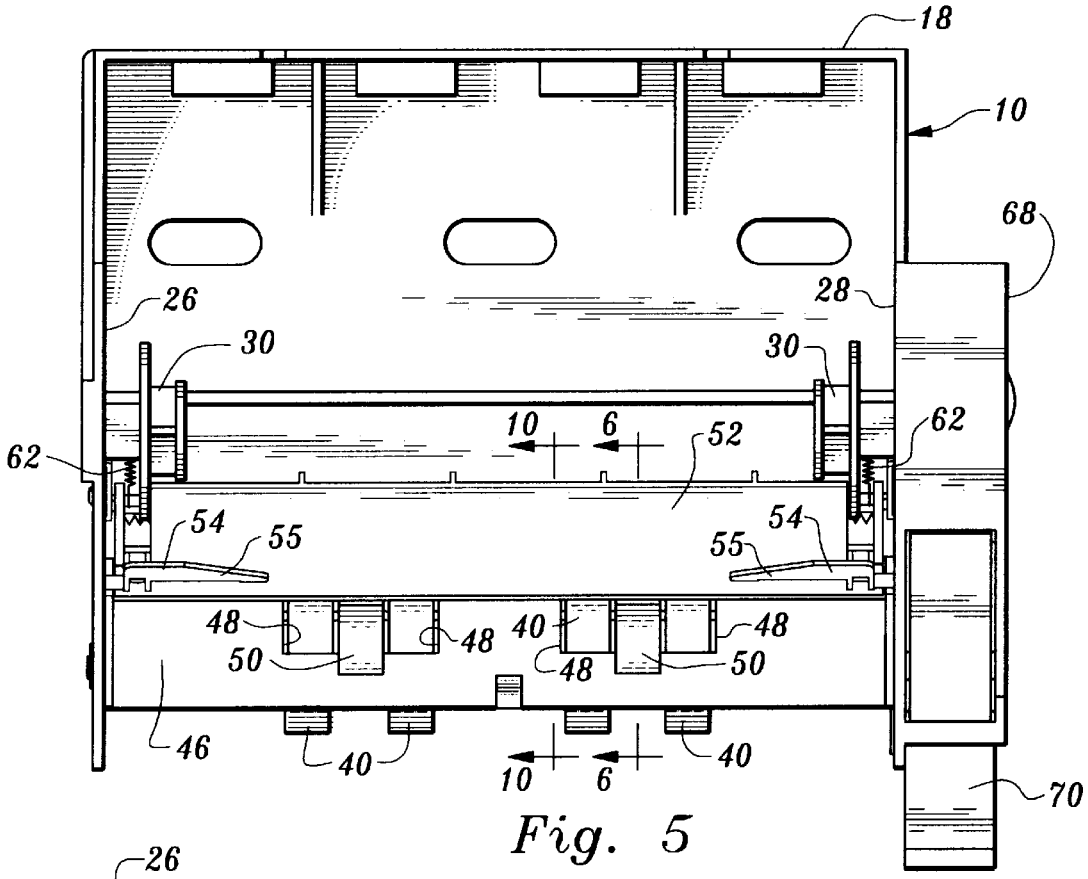
FIG. 5 is an enlarged plan view taken along the line 5—5 in FIG. 3.
Figure 6:
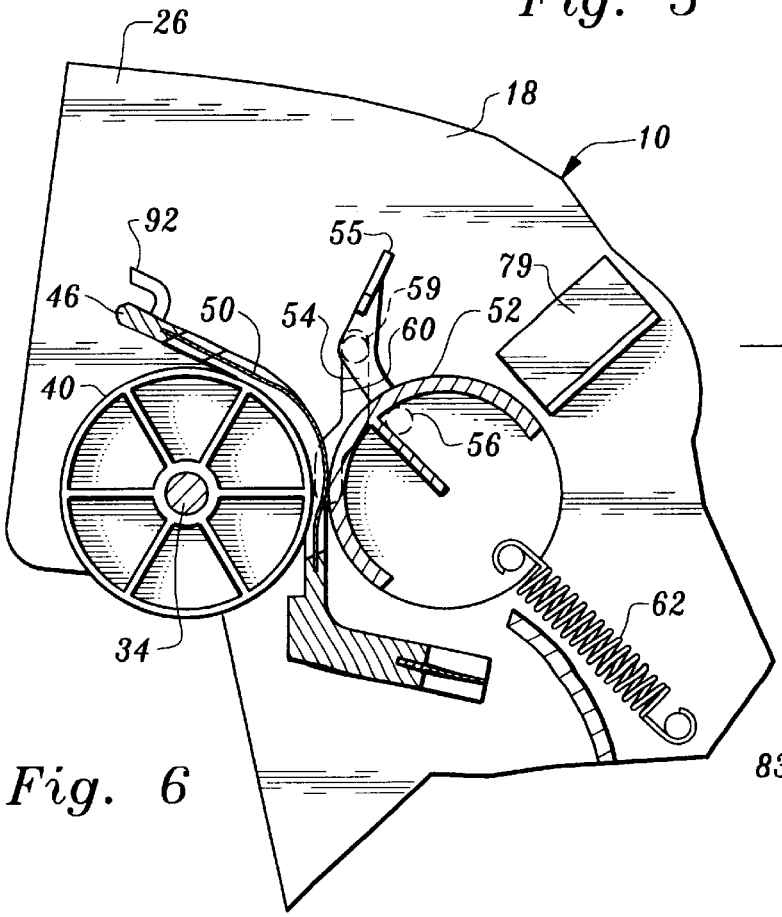
FIG. 6 is an enlarged cross-sectional view of that portion of the apparatus delineated by line 6—6 in FIG. 5.

Tucker members 54 are located at the ends of sheet material engagement member 52 and are pivotally connected thereto. The tucker members are of the same construction except that they are mirror images of one another, one being of "right hand" construction and one being of "left hand" construction. The tucker members 54 are spaced from one another and define a space or gap therebetween, each tucker member including a tucker element 55 spaced from sheet material engagement member 52 and extending generally parallel to the rotational axis of sheet material engagement member 52. See FIG. 5 for example.

Each tucker member includes a pivot pin 56 which is positioned in a recess 57 formed in the sheet material engagement member 52. A recess 57 is located at each end of the sheet material engagement member and each recess includes an elongated recess segment 58 formed in the outer surface of the sheet material engagement member and extending substantially parallel to the axis of rotation thereof. A tucker member may be readily pivotally connected to or detached from the sheet material engagement member, the elongated recess segment facilitating positioning of the pivot pin 56 in place or its removal. Each tucker member 54 also includes a guide projection in the form of pin 59 which extends into a trackway slot 60 formed in a side wall of the inner housing segment 18. Slots 60 are formed in each of the side walls 26, 28.

As will be described in greater detail below, the member 52 will only rotate under certain circumstances. When it does, tucker members 54 will rotate with the sheet material engagement member. Furthermore, the tucker members will simultaneously pivot relative to the sheet material engagement member 52 during rotation thereof.

Biasing means is provided to resist rotational movement of member 52 and the tucker members. More particularly, the biasing means is in the form of a tension springs 62 extending from the ends of the sheet material engagement member to the inner housing segment.

Side wall 28 includes two spaced wall panels 66, 68 defining a chamber within which is located a pivotally mounted manually actuatable member in the form of a push lever 70. A portion of the push lever 70 extends forwardly and is engageable by a consumer using the dispenser apparatus. Push lever 70 is pivotal about a support 72 extending between the wall panels 66, 68. A slot 74 is formed in the push lever and the upper end of the slot is defined by a toothed rack 76. Elongated shaft 34 projects through the slot 74. A pinion 78 is affixed to the distal end of the shaft between the wall panels, the pinion engaging the teeth of toothed rack 76.

Figure 11:
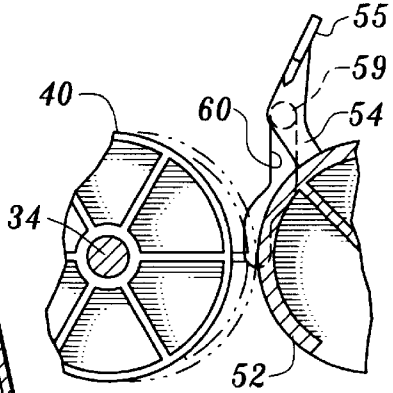
FIG. 11 is an enlarged diagrammatic view illustrating portions of the feed roller and sheet material engagement member as depicted in FIG. 10 and their relationship with sheet material and a tucker member.

A tension spring 80 extends between push lever 70 and a panel 82 projecting from side wall 28. Spring 80 continuously urges the push lever 70 to the position shown in FIG. 9. When the push lever has been depressed and the spring 80 returns the push lever to the position of rest shown in FIG. 9 the shaft 34 and pinion 78 are temporarily displaced toward the front of the housing to a certain extent so that the feed roller segments 40 are withdrawn from contact with sheet material engagement member 52 for a short period of time. This condition can be seen in the solid line depictions of the shaft, pinion and roller in FIGS. 9 and 11 and also in FIGS. 6, 10, 15, 16, 19, 20 and 21. However, these elements almost immediately return to the positions illustrated in phantom line in FIGS. 9 and 11 and in solid lines in FIGS. 13, 14, 17, 18 and 22, for example.

Figure 7:
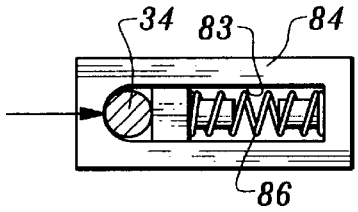
FIG. 7 is a greatly enlarged cross-sectional view showing details of structure employed to bias a pivoted feed roller support shaft employed in the apparatus, as taken along line 7—7 in FIG. 4.
Figure 8:
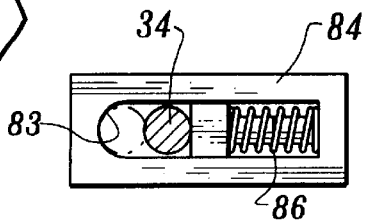
FIG. 8 is a view similar to FIG. 7 but illustrating structural components in different relative positions.
Figure 10:
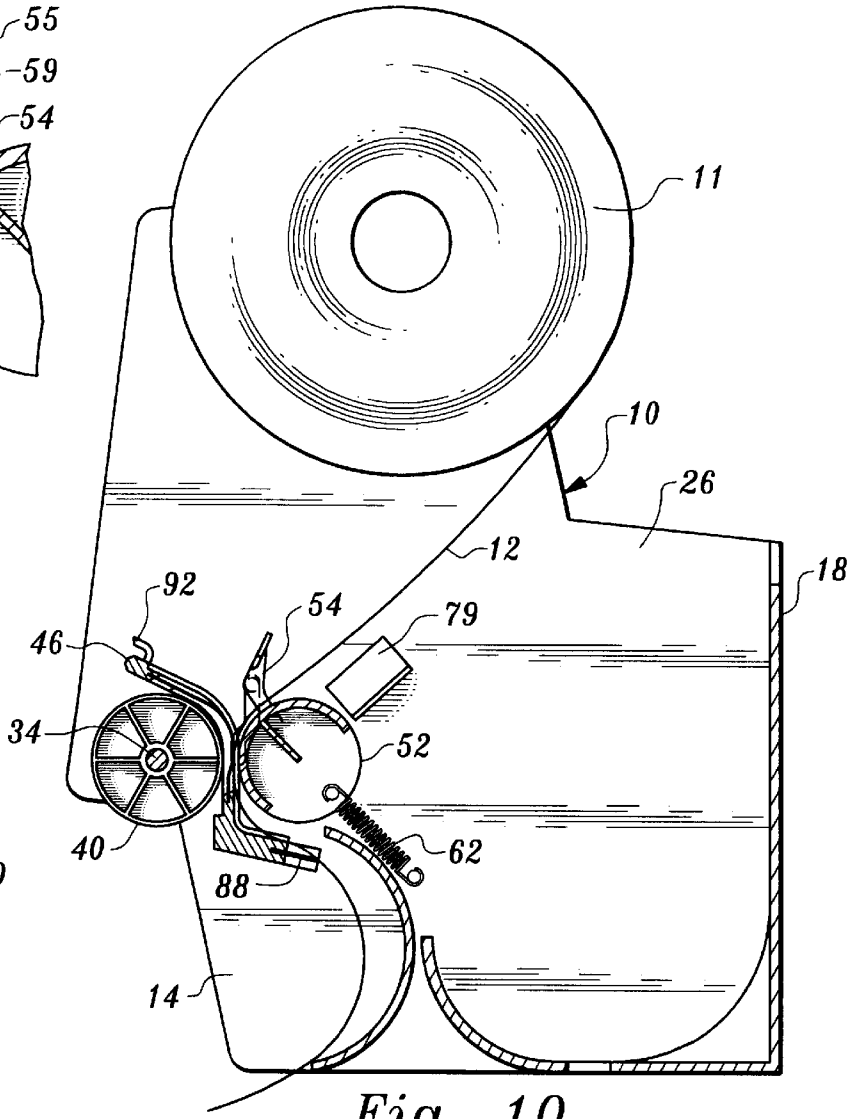
FIG. 10 is a sectional view taken along line 10—10 in FIG. 5 and illustrating in solid lines the relative positions assumed by the feed roller and sheet material engagement member of the apparatus when sheet material is disposed therebetween and the actuator lever has just returned from being depressed by the user to the position shown in FIG. 9.

With particular reference to FIGS. 5, 7, 8, 21 and 22, the distal or free end of shaft 34 passes through a guide slot 83 of an enclosure 84 attached to side wall 28. A compression spring 86 in enclosure 84 continuously biases the shaft 34 and roller segments toward member 52 and immediately after the actuator lever has been depressed and returns to rest position, spring 86 returns the roller segments into contact with member 52 with shaft 34 again parallel to the rotational axis of member 52. This latter shaft position is shown in FIG. 7 in solid line and in FIG. 8 in phantom line.

Spring members 50 engage any toweling on member 52 at all times to prevent shifting and possible jamming thereof resulting from momentary displacement of roller segments 40 from the toweling. The length of slot 83 limits pivotal movement of the shaft and thus limits and controls nip pressure between feed roller segments 40 and member 52. The pinion 78 is maintained in contact with the teeth of toothed rack 76 by virtue of the fact that shaft 34 rides in slot 83. Slot 83 limits the degree of pivotal movement of the shaft and thus also the feed roller segments.

Figure 12:
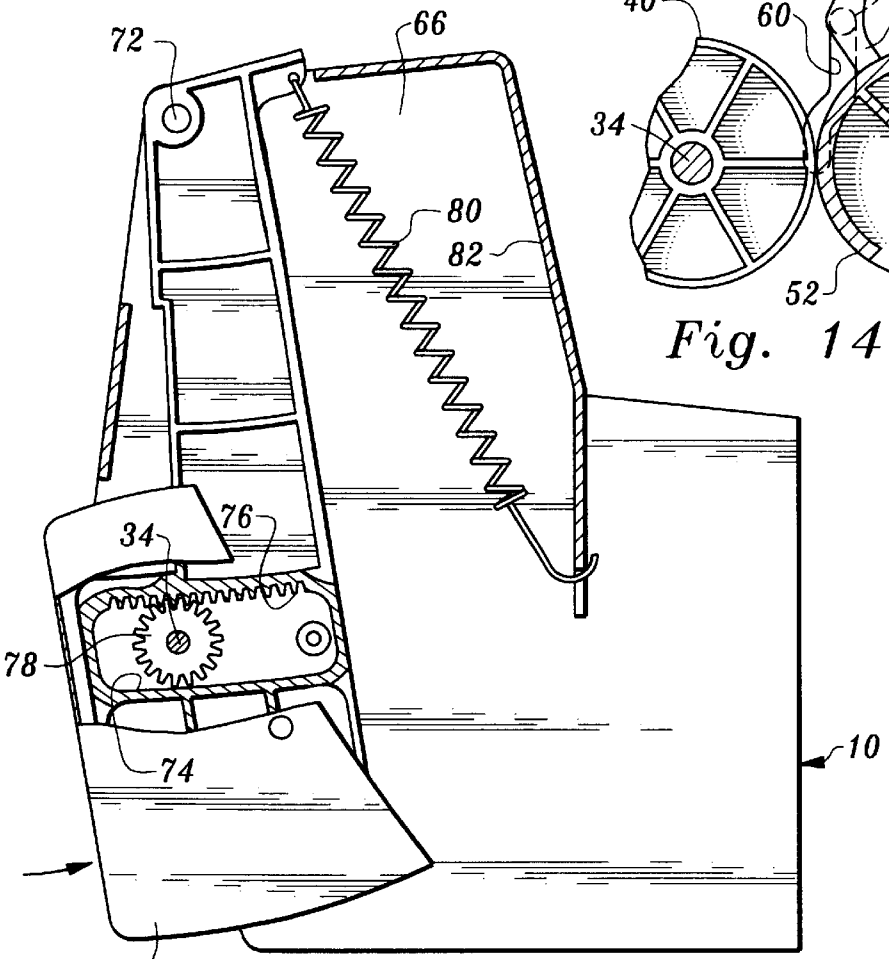
FIG. 12 is a view similar to FIG. 9 but illustrating the actuator lever being depressed.

FIG. 12 illustrates the push lever 70 being depressed in the direction of the illustrated arrow. This will result in rotation of shaft 34 and the feed roller segments due to the cooperation of the pinion 78 and rack 76.

Figure 13:
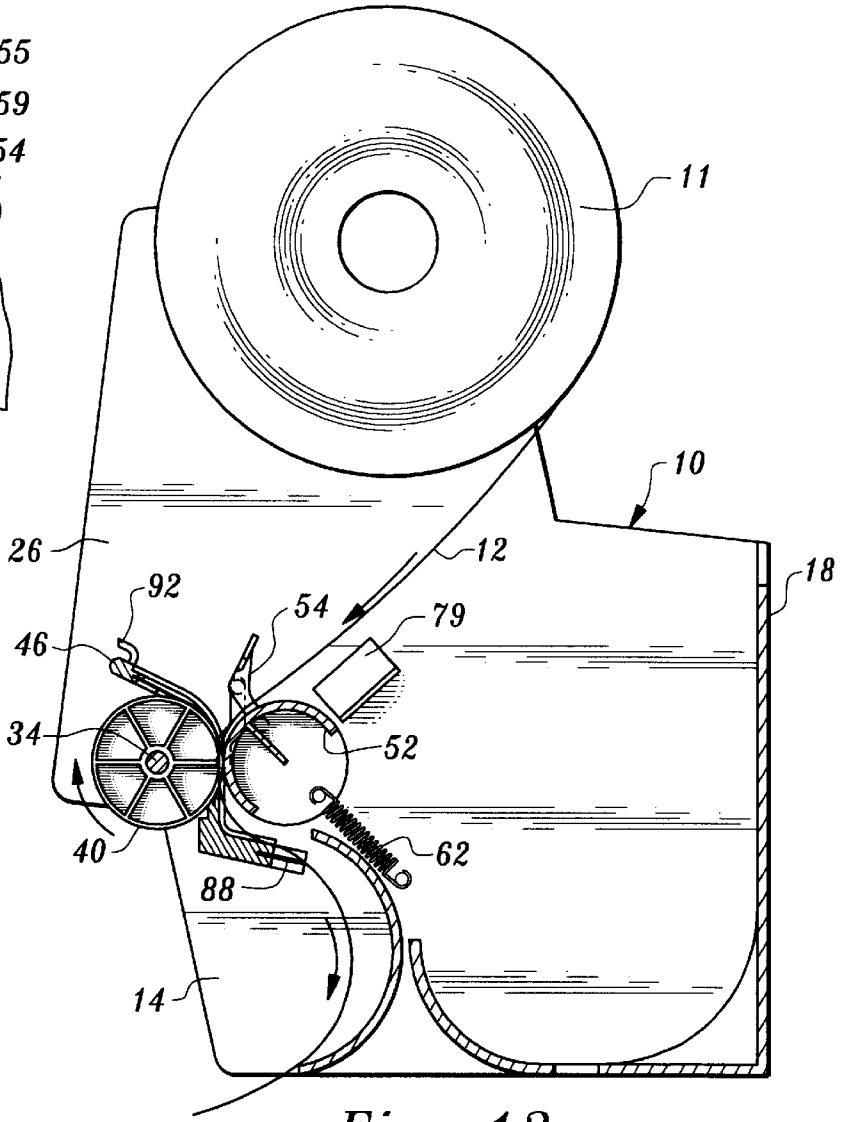
FIGS. 13 and 14 are views similar to those depicted in FIGS. 10 and 11 but showing the positions assumed by the illustrated components when the actuator lever is depressed as shown in FIG. 12.
Figure 14:
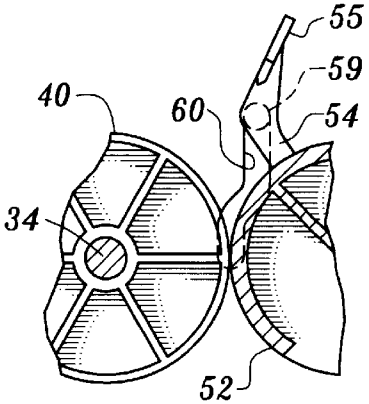

In FIGS. 13 and 14 paper toweling 12 has been prepositioned between the sheet material engagement member 52 and the feed roller segments 40 so the paper toweling is pinched in a nip formed between the member 52 and the feed roller segments. Rotation of the shaft and feed roller segments will cause the paper toweling to move downwardly through the nip and be unwound from the roll 11 as indicated by the arrow in FIG. 13. This is due to the fact that a higher coefficient of friction exists at the outer peripheral surface of the feed roller segments than at the outer surface of member 52. The feed roller segments will frictionally engage and transport the toweling while the toweling slides along the smooth outer curved surface of non-rotating member 52. As previously indicated, rotation of member 52 is resisted by tension spring 60. After the feed roller segments have caused transport of paper toweling toward the outlet 14 past curved plate 15 a consumer can grasp the free end of the toweling and manipulate the toweling to sever a length thereof along serrated blade 88 fixedly mounted in the housing.

Figure 9:
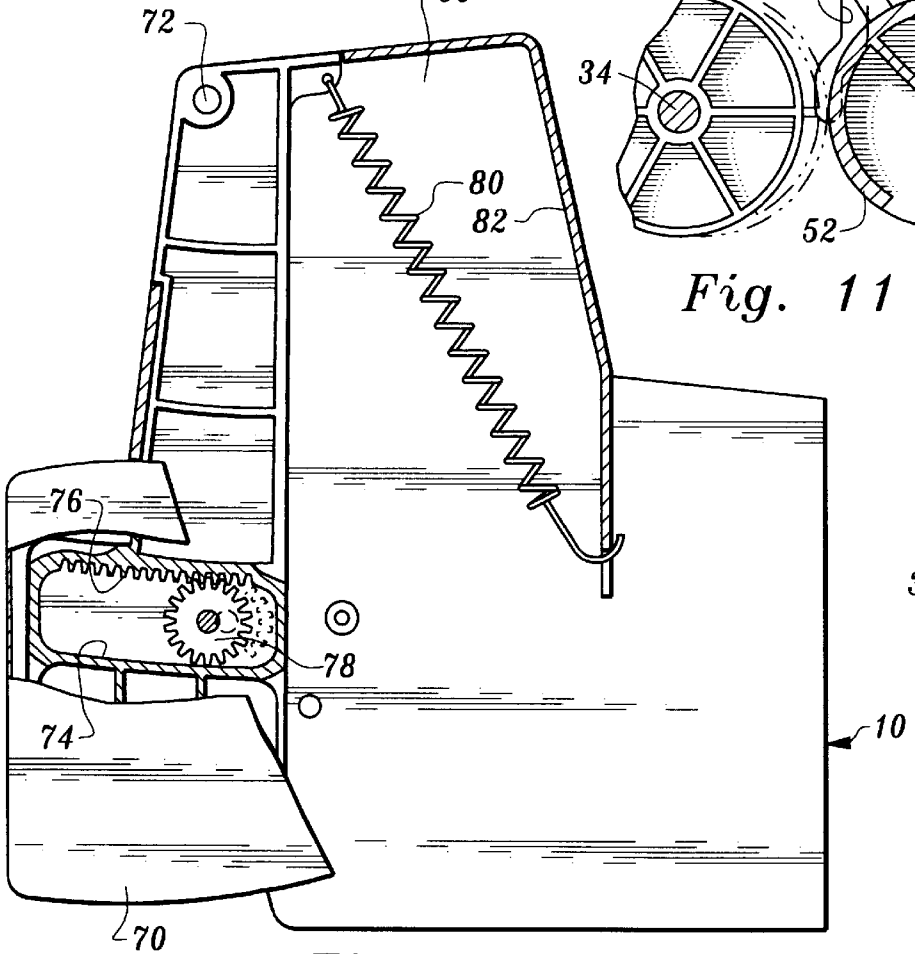
FIG. 9 is an enlarged sectional view illustrating a portion of the apparatus delineated by section line 9—9 in FIG. 4 and illustrating the actuator lever of the apparatus in a non-depressed position.

After the consumer stops pushing against push lever 70, the push lever will return to the position illustrated in FIG. 9. Return movement of the push lever to its non-depressed state will cause the distal end of the shaft (the end having the pinion 78 attached thereto) to move away from member 52. The feed roller segments will also temporarily move away from member 52 as previously described.

Figures 15, 16, 17, 18:
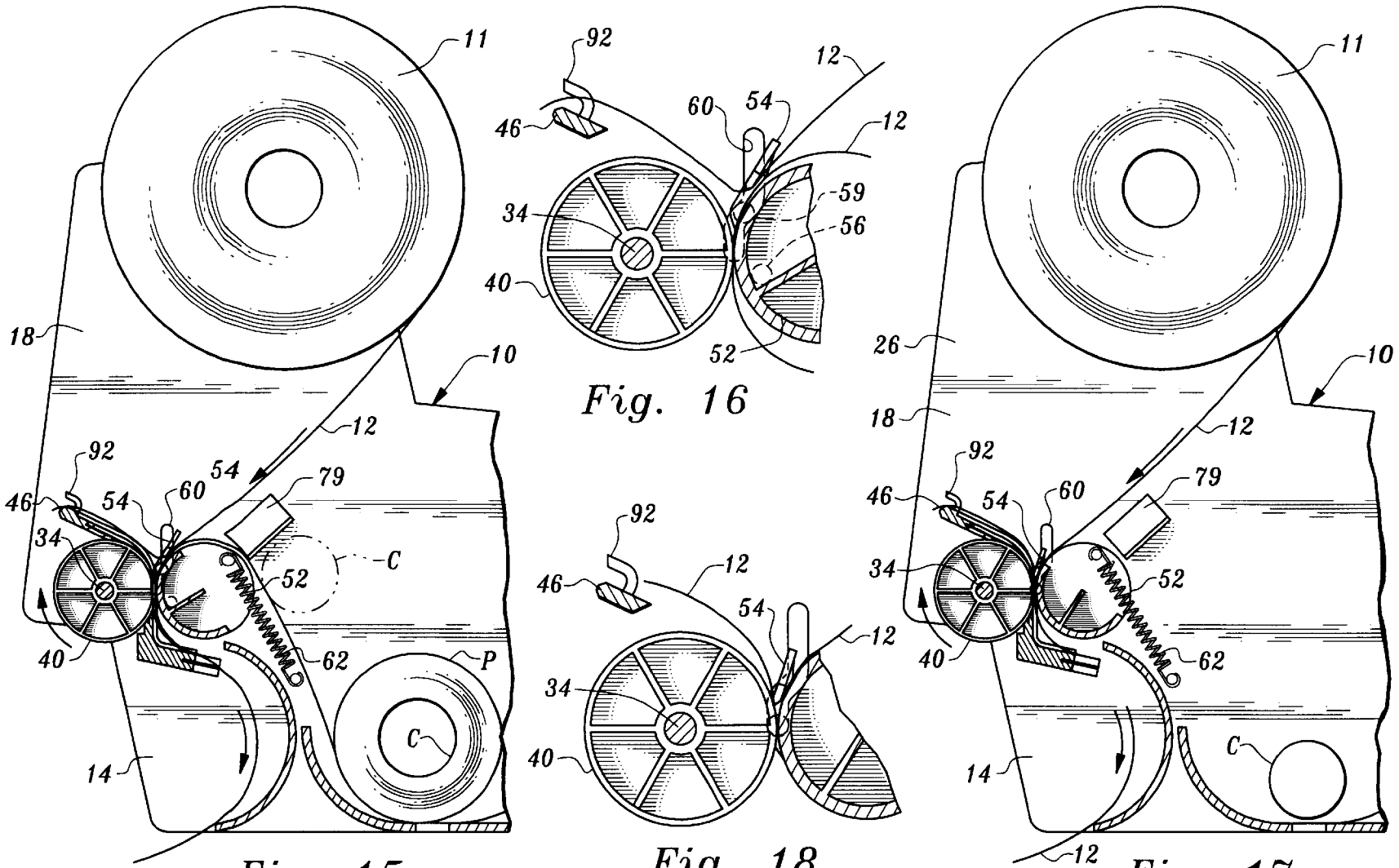
FIG. 15 is a sectional side view similar to FIG. 10 but illustrating both primary and reserve rolls of paper toweling in position and the relationship thereof to other structure of the apparatus before depletion of the primary roll.
FIG. 16 is a view similar to FIG. 11 but showing toweling from both the primary and reserve rolls and positions thereof relative to the feed roller, sheet material engagement member and a tucker member of the apparatus when the actuator lever has just returned from being depressed by the user.
FIG. 17 illustrates the relative positions and cooperable relationships of the structural components shown when transfer to a reserve roll from a depleted primary roll is being initiated due to depression of the actuator lever and movement of a tucker member.
FIG. 18 is a view similar to FIG. 16 but illustrating the situation after depletion of the primary roll and movement of a tucker member responsive to engagement between the feed roller and sheet material engagement member upon depression of the actuator lever.

The apparatus of the present invention incorporates structural components which cooperate to provide for the automatic transfer to a reserve roll of paper toweling upon depletion of a primary roll of paper toweling. In FIG. 15, a partially depleted primary roll of toweling P having a core C has been repositioned by an attendant into a well or recess located at the bottom of the housing and a full reserve roll 11 has been placed between the projections 30. Abutment or stop members 79 are connected to the housing and will limit upward movement of roll P during dispensing so that it will not interfere with operation of the tucker members or other mechanism.

Toweling 12 from the full reserve roll is placed over sheet material engagement member 52, the edges of the toweling slipped under tucker members 54 and the toweling positioned over guide plate 46 which, if desired, can be sharpened or serrated so that it can be used to square off the toweling end. In the interest of simplicity, such feature is not illustrated. Toweling 12 from the reserve roll 11 is kept in place and out of engagement with the feed roller segments by impaling the free end of the toweling on a projection 92 affixed to the guide plate 96. See FIGS. 15, 16 and 17.

As soon as the tail end of the toweling from roll P passes between the nip formed by member 52 and feed roller segments 40 the feed roller segments will be placed into direct contact with member 52. This engagement will cause member 52 to rotate with the feed roller segments as shown in FIG. 17 against the urging of springs 62. This will cause the tucker members 54 to rotate downwardly toward a location wherein the tucker element 55 of each tucker member is between the member 52 and the feed roller segments. This is shown in FIG. 18.

Figure 23:
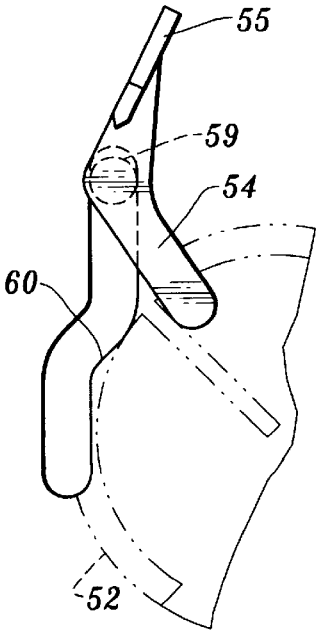
FIGS. 23–25 are diagrammatic side elevation views showing alternative orientations and positions assumed by a tucker member during rotation of the sheet material engagement member, the latter shown in dash lines.
Figure 24:
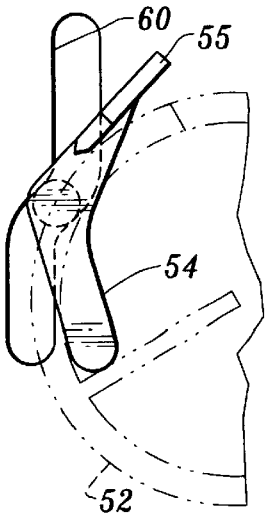
Figure 25:
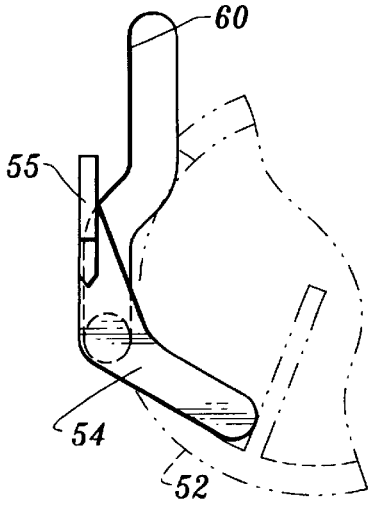
Figure 21:
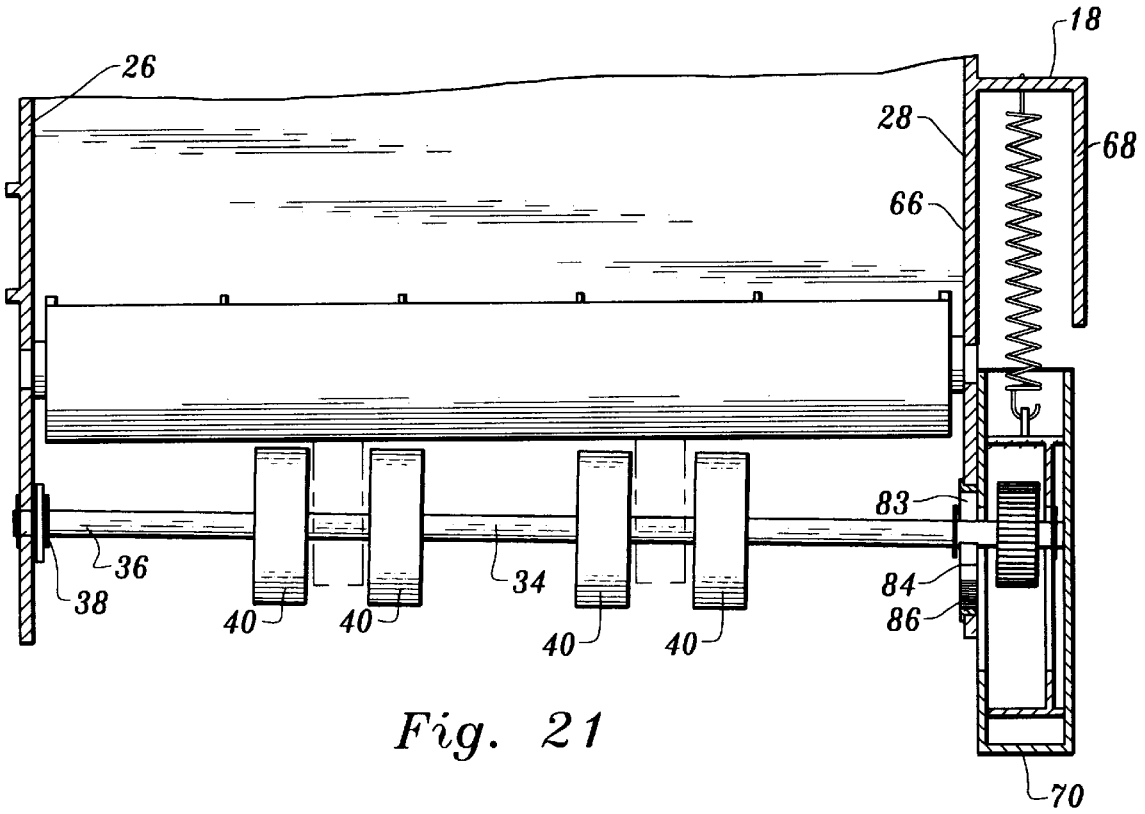
FIG. 21 is an enlarged sectional top view illustrating the feed roller and support shaft of the apparatus pivoted away from the sheet material engagement member as well as associated structure including the actuator lever in non-depressed condition.
Figure 22:
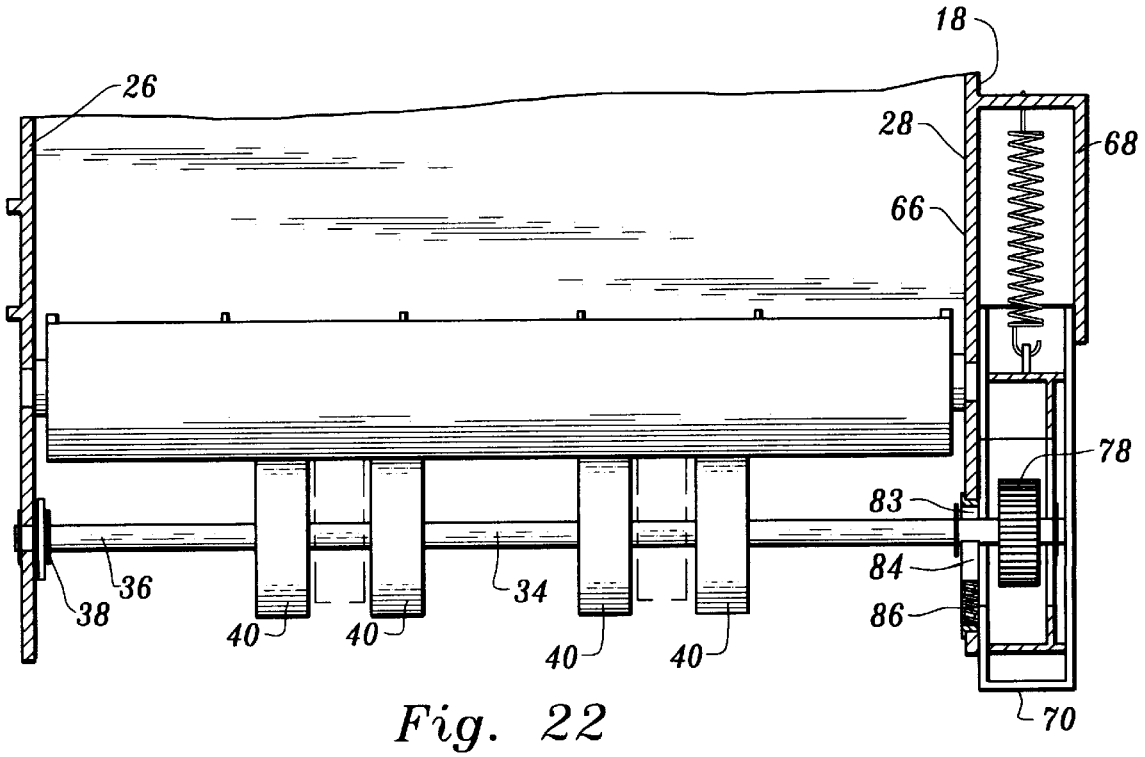
FIG. 22 is a view similar to FIG. 21 but illustrating segments of the feed roller of the apparatus in direct engagement with the rotatable sheet material engagement member and the actuator lever depressed.
Figure 26:
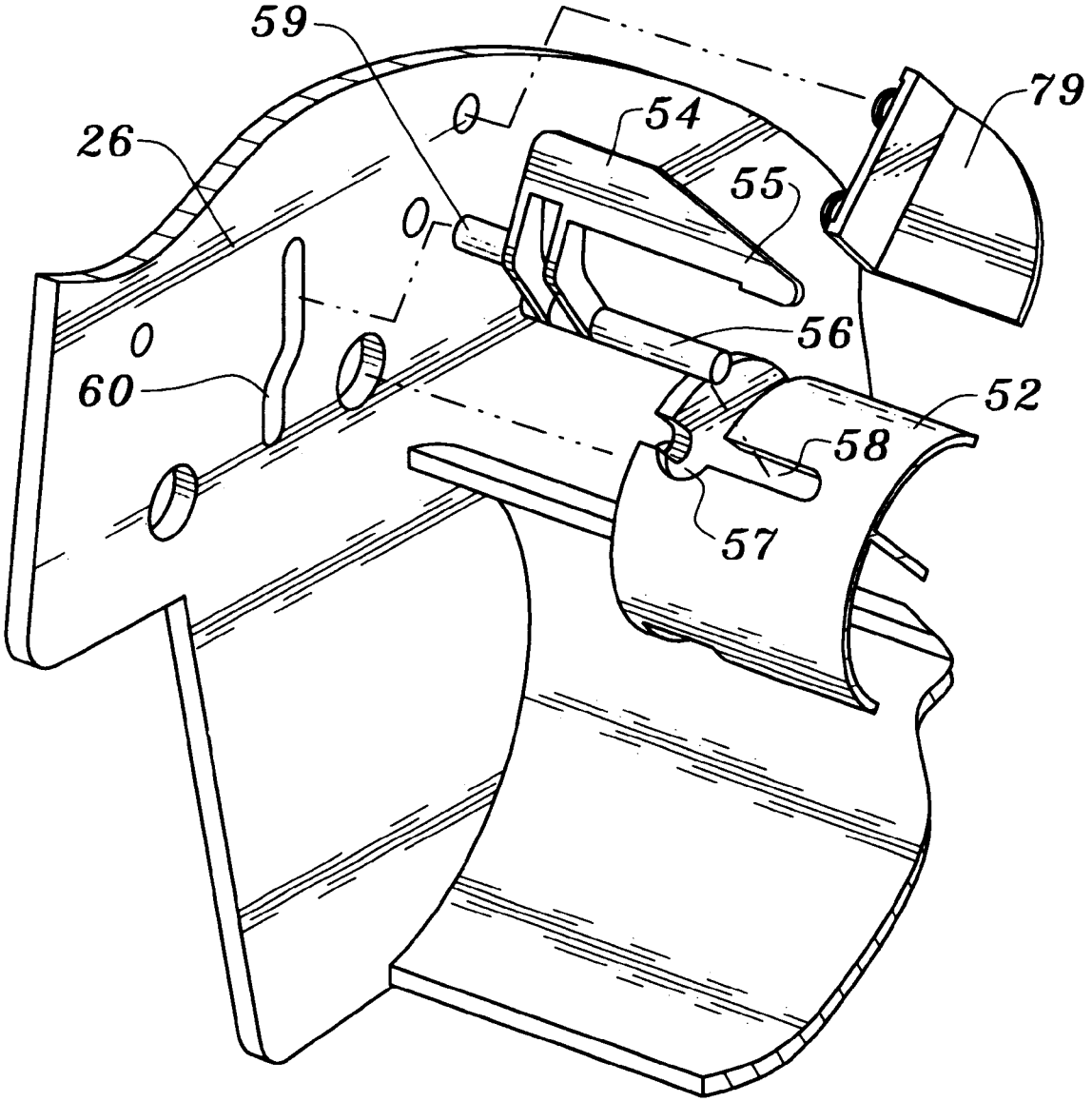
FIG. 26 is an enlarged, perspective exploded view illustrating details of a tucker member and related structure.

As the tucker members rotate with the sheet material engagement member 52, they will also pivot relative to member 52, pivotal motion being effected and guided by movement of projections 59 in slots 60. FIGS. 23, 24 and 25 illustrate this action and show the disclosed structural components in the relative positions assumed thereby during sequential stages of operation.

Figure 20:
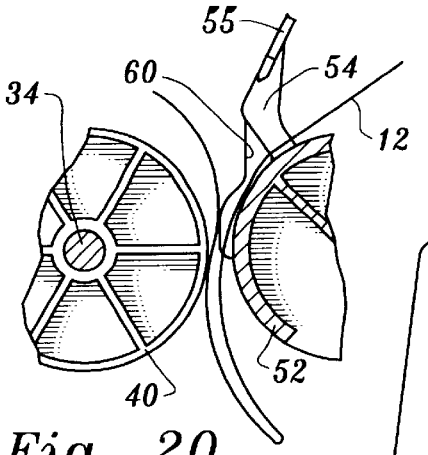
FIGS. 19 and 20 illustrate the conditions of the illustrated apparatus components and associated lead end of the reserve roll after transfer from the depleted primary roll has taken place.
Figure 19:
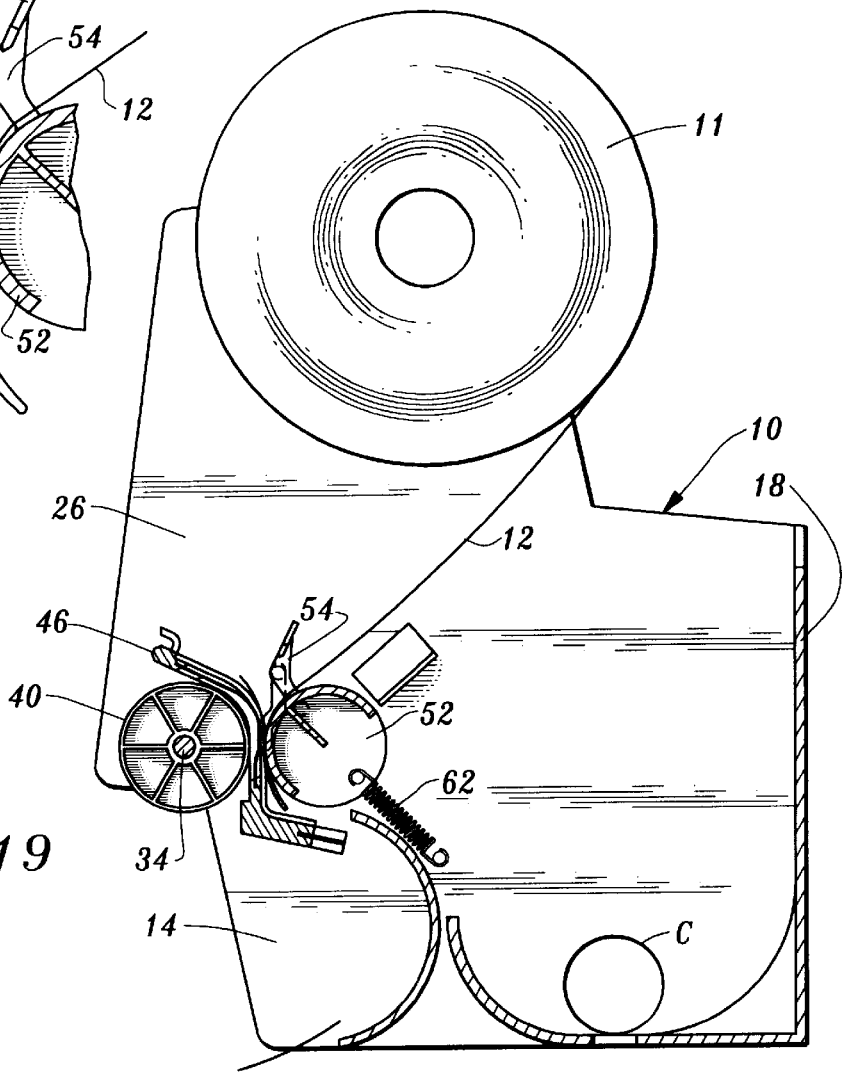

The lead end of the toweling from the reserve roll is torn from projection 92 and wedged in position between the feed roller segments 40 and the member 52 by the tucker mechanism and will remain in position therebetween after the push lever, the member 52 and tucker members return to their initial positions. This situation is shown in FIGS. 19 and 20. Renewed depression of the push lever 70 will then cause dispensing from the new or i reserve roll.

What is claimed is:

1. Apparatus for dispensing sheet material from a roll of sheet material, said apparatus comprising, in combination:

a housing defining an interior for accommodating a roll of sheet material and additionally defining a sheet material outlet communicating with said interior;

a double-ended rotatable sheet material engagement member having an outer surface for engaging sheet material unwound from the roll of sheet material within the housing interior;

sheet material feed means positioned adjacent to said rotatable sheet material engagement member including a rotatable sheet material feed roller and a support member supporting said sheet material feed roller, said support member being pivotally mounted relative to said housing to selectively alternatively move said sheet material feed roller toward or away from said rotatable sheet material engagement member;

means for rotating said sheet material feed roller to transport sheet material engaged by said rotatable sheet material engagement member and by said sheet material feed roller toward said sheet material outlet after said sheet material feed roller has moved toward said rotatable sheet material engagement member; and a pair of tucker members connected to said rotatable sheet material engagement member, one of said tucker members located at one end of said rotatable sheet material engagement member and the other of said tucker members located at the other end of said rotatable sheet material engagement member, said tucker members defining a space therebetween, said tucker members responsive to rotational movement of said rotatable sheet material engagement member to move toward a location between said sheet material feed roller and said rotatable sheet material engagement member to tuck the lead end of the roll of sheet material between said sheet material feed roller and said rotatable sheet material engagement member.

2. The apparatus according to claim 1 wherein said tucker members are independently pivotally connected to their respective ends of said rotatable sheet material engagement member.

3. The apparatus according to claim 2 additionally comprising guide means for guiding pivotal movement of said tucker members during rotation of said rotatable sheet material engagement member.

4. The apparatus according to claim 3 wherein said guide means includes trackways located adjacent to said tucker members and engageable thereby during rotation of said rotatable sheet material engagement member.

5. The apparatus according to claim 4 wherein said trackways comprise slots located adjacent to the ends of said rotatable sheet material engagement member, said tucker members including projections located in and movable within said slots.

6. The apparatus according to claim 4 wherein said housing includes spaced housing side walls, said rotatable sheet material engagement member being rotatable between and supported by said housing side walls and said trackways comprising slots defined by said housing side walls adjacent to said rotatable sheet material engagement member.

7. The apparatus according to claim 2 wherein a recess is defined by each end of said rotatable sheet material engagement member, each said tucker member including a pivot element releasably positioned in the recess.

8. The apparatus according to claim 7 wherein said pivot element comprises a pivot pin, each said recess including an elongated recess segment formed in the outer surface of said rotatable sheet material engagement member and extending in a direction substantially parallel to the axis of rotation of said rotatable sheet material engagement member, said elongated recess segments facilitating the attachment or removal of said tucker members relative to said rotatable sheet material engagement member.

9. The apparatus according to claim 1 wherein said tucker members are connected to said rotatable sheet material engagement member for rotatable movement with said rotatable sheet material engagement member, said apparatus including biasing means for biasing said rotatable sheet material engagement member against rotational movement.

10. The apparatus according to claim 9 wherein said biasing means comprises a tension spring interconnecting said housing and said rotatable sheet material engagement member.

11. The apparatus according to claim 1 wherein each said tucker member includes a tucker element spaced from said rotatable sheet material engagement member and extending generally parallel to the rotational axis of said rotatable sheet material engagement member.

12. The apparatus according to claim 1 wherein said rotatable sheet material engagement member has a curved outer surface directly engageable by said sheet material feed roller to cause rotation of said rotatable sheet material engagement member and substantially simultaneous movement of said tucker members toward said location responsive to rotation of said sheet material feed roller after the tail end of a roll of sheet material has passed between said sheet material feed roller and said rotatable sheet material engagement member.

13. The apparatus according to claim 1 wherein said housing includes opposed side walls, and wherein said support member comprises a double-ended shaft, one of the ends of said double-ended shaft being pivotally connected to one of said side walls.

14. The apparatus according to claim 13 wherein the other end of said double-ended shaft is connected to said means for rotating said sheet material feed roller and movable therewith.

15. The apparatus according to claim 14 wherein said means for rotating said sheet material feed roller includes a movable manually actuatable member and transmission means interconnecting said movable manually actuatable member and said double-ended shaft and responsive to movement of said movable manually actuatable member to rotate said double-ended shaft and said sheet material feed roller, pivot said double-ended shaft, and move said sheet material feed roller toward said rotatable sheet material engagement member.

16. The apparatus according to claim 15 wherein said transmission means includes a toothed rack connected to said movable manually actuatable member and a pinion attached to said other end of said double-ended shaft engaging said toothed rack and rotatable in response to movement of said toothed rack.

17. The apparatus according to claim 15 wherein said movable manually actuatable member is movable between two positions, said apparatus additionally comprising means continuously biasing said movable manually actuatable member to one of said positions.

18. The apparatus according to claim 15 additionally comprising shaft biasing means located at said other end of said double-ended shaft for biasing said double-ended shaft toward said sheet material engagement means.

19. The apparatus according to claim 1 wherein said sheet material feed roller has an outer feed roller surface having a coefficient of friction greater than the coefficient of friction of the outer surface of said rotatable sheet material engagement member.

20. The apparatus according to claim 1 wherein said housing includes an outer housing segment and an inner housing segment releasably connected to said outer housing segment and selectively removable therefrom, said support member being pivotally connected to said inner housing segment and said sheet material feed means and said rotatable sheet material engagement member being supported by said inner housing segment.

21. The apparatus according to claim 1 additionally comprising abutment means connected to said housing adjacent to the ends of said rotatable sheet material engagement member for limiting movement of a partially depleted roll of sheet material in said housing during dispensing of toweling from said partially depleted roll so that said partially depleted roll will not engage the tucker members.

22. Apparatus for dispensing sheet material from a roll of sheet material, said apparatus comprising, in combination:

a housing defining an interior for accommodating a roll of sheet material and additionally defining a sheet material outlet communicating with said interior;

a rotatable sheet material engagement member having an outer surface for engaging sheet material unwound from the roll of sheet material within the housing interior;

rotatable sheet material feed roller means having an outer feed roller surface with a coefficient of friction greater than that of the outer surface of said rotatable sheet material engagement member located adjacent to said rotatable sheet material engagement member;

double-ended shaft means supporting said sheet material feed roller means, said shaft means being pivotally mounted relative to said housing to selectively alternatively move said sheet material feed roller means toward or away from said rotatable sheet material engagement member;

means for rotating said sheet material feed roller means to transport sheet material engaged by said sheet material feed roller means and said rotatable sheet material engagement member toward said sheet material outlet after said double-ended shaft means has been pivoted to move said sheet material feed roller means toward said rotatable sheet material engagement member; and a tucker member connected to a first end of said rotatable sheet material engagement member and rotatable with said rotatable sheet material engagement member to move toward a location between said sheet material feed roller means and said rotatable sheet material engagement member to tuck the lead end of the roll of sheet material between said sheet material feed roller means and said rotatable sheet material engagement member, said tucker member having a tucker element extending generally parallel to the rotational axis of said rotatable sheet material engagement member a distance less than half of the length of said rotatable sheet material engagement member.

23. The apparatus according to claim 22 wherein said tucker member is pivotally connected to said first end of said rotatable sheet material engagement member.

24. The apparatus according to claim 23 additionally comprising a second tucker member pivotally connected to said rotatable sheet material engagement member at a second end thereof, said second tucker member having a tucker element extending generally parallel to the rotational axis of said rotatable sheet material engagement member a distance less than half the length of said rotatable sheet material engagement member, said tucker members defining a space therebetween.

25. The apparatus according to claim 23 wherein said rotatable sheet material engagement member outer surface is directly engageable by said rotatable sheet material feed roller means to rotate said rotatable sheet material engagement member responsive to rotation of said rotatable sheet material feed roller means.

26. Apparatus for dispensing sheet material from a roll of sheet material, said apparatus comprising, in combination:

a housing defining an interior for accommodating a primary roll of sheet material having a tail end and a reserve roll of sheet material having a lead end;

a double-ended sheet material engagement member;

a rotatable sheet material feed member mounted adjacent to said sheet material engagement member;

a first tucker member located adjacent to one end of said sheet material engagement member and a second tucker member located adjacent to the other end of said sheet material engagement member, each said tucker member having a tucker element, the tucker elements of said tucker members extending toward one another and defining a space therebetween;

means for rotating said rotatable sheet material feed roller means; and means responsive to rotation of said rotatable sheet material feed roller means causing movement of said tucker members and further causing said tucker members to substantially simultaneously tuck the lead end of the reserve roll of sheet material between said rotatable sheet material feed roller means and said sheet material engagement member.

27. The apparatus according to claim 26 wherein said sheet material engagement member is rotatable, said apparatus additionally comprising biasing means biasing said sheet material engagement member against rotation.

28. The apparatus according to claim 27 wherein said tucker members are connected to opposed ends of said sheet material engagement member and rotate with said sheet material engagement member.

29. The apparatus according to claim 26 wherein said tucker members are pivotally connected to opposed ends of said sheet material engagement member.

30. The apparatus according to claim 29 additionally comprising guide means for guiding pivotal movement of said tucker members.

31. Apparatus for dispensing sheet material from a roll of sheet material, said apparatus comprising, in combination:

a housing defining an interior for accommodating a roll of sheet material and additionally defining a sheet material outlet communicating with said interior;

a rotatable sheet material engagement member for engaging sheet material unwound from the roll of sheet material within the housing interior;

sheet material feed means positioned adjacent to said rotatable sheet material engagement member including a rotatable sheet material feed roller and a support member supporting said sheet material feed roller, said support member being pivotally mounted relative to said housing to selectively alternatively move said sheet material feed roller toward or away from said rotatable sheet material engagement member;

means for rotating said sheet material feed roller to transport sheet material engaged by said rotatable sheet material engagement member and by said sheet material feed roller toward said sheet material outlet after said sheet material feed roller has moved toward said rotatable sheet material engagement member; and a plurality of tucker members connected to said rotatable sheet material engagement member, said tucker members responsive to rotational movement of said rotatable sheet material engagement member to move toward a location between said sheet material feed roller and said rotatable sheet material engagement member to tuck the lead end of the roll of sheet material between said sheet material feed roller and said rotatable sheet material engagement member.

32. Apparatus for dispensing sheet material from a roll of sheet material, said apparatus comprising, in combination:

a housing defining an interior for accommodating a primary roll of sheet material having a tail end and a reserve roll of sheet material having a lead end;

sheet material engagement means;

a rotatable sheet material feed member feed roller mounted for movement toward and away from said sheet material engagement means;

a plurality of spaced tucker members; and means for rotating said rotatable sheet material feed roller, said tucker members rotating in response to rotation of said rotatable sheet material feed roller and passage of the tail end of the primary roll of sheet material between said rotatable sheet material feed roller and said sheet material engagement means to tuck the lead end of the reserve roll of sheet material between said rotatable sheet material feed roller and said sheet material engagement member.

33. Apparatus for dispensing sheet material from a roll of sheet material, said apparatus comprising, in combination:

a housing defining an interior for accommodating a primary roll of sheet material having a tail end and a reserve roll of sheet material having a lead end;

a rotatable sheet material engagement member;

a rotatable sheet material feed member mounted for movement toward and away from said rotatable sheet material engagement member;

a plurality of tucker members; and means for rotating said rotatable sheet material feed member and for moving said rotatable sheet material feed member toward said rotatable sheet material engagement member, said rotatable sheet material engagement member rotating in response to rotation of said rotatable sheet material feed member and passage of the tail end of the primary roll of sheet material between said rotatable sheet material feed member and said rotatable sheet material engagement member and causing movement of said tucker member to tuck the lead end of the reserve roll of sheet material between said rotatable sheet material feed member and said rotatable sheet material engagement member, said tucker members being movably connected to said rotatable sheet material engagement member and rotatable therewith.

34. Apparatus for dispensing sheet material from a roll of sheet material, said apparatus comprising, in combination:

a housing defining an interior for accommodating a roll of sheet material and additionally defining a sheet material outlet communicating with said interior;

a double-ended rotatable sheet material engagement member having an outer surface for engaging sheet material unwound from the roll of sheet material within the housing interior;

sheet material feed means positioned adjacent to said rotatable sheet material engagement member including a rotatable sheet material feed roller and a support member supporting said sheet material feed roller, said support member being pivotally mounted relative to said housing to selectively alternatively move said sheet material feed roller toward or away from said rotatable sheet material engagement member;

means for rotating said sheet material feed roller to transport sheet material engaged by said rotatable sheet material engagement member and by said sheet material feed roller toward said sheet material outlet after said sheet material feed roller has moved toward said rotatable sheet material engagement member; and a tucker member connected to an end of said rotatable sheet material engagement member, said tucker member responsive to rotational movement of said rotatable sheet material engagement member to pivot relative to said rotatable sheet material engagement member and move toward a location between said sheet material feed roller and said rotatable sheet material engagement member to tuck the lead end of the roll of sheet material between said sheet material feed roller and said rotatable sheet material engagement member.

35. The apparatus according to claim 34 additionally comprising guide means for guiding pivotal movement of said tucker member during rotation of said rotatable sheet material engagement member.

36. The apparatus according to claim 35 wherein said guide means includes a trackway located adjacent to said tucker member and engageable thereby during rotation of said rotatable sheet material engagement member.

37. The apparatus according to claim 36 wherein said trackway comprises a slot located adjacent to an end of said rotatable sheet material engagement member, said tucker member including a projection located in and movable within said slot.

38. The apparatus according to claim 34 wherein a recess is defined by an end of said rotatable sheet material engagement member, said tucker member including a pivot element releasably positioned in said recess.

39. The apparatus according to claim 38 wherein said pivot element comprises a pivot pin, said recess including an elongated recess segment formed in the outer surface of said rotatable sheet material engagement member and extending in a direction substantially parallel to the axis of rotation of said rotatable sheet material engagement member, said elongated recess segment facilitating the attachment or removal of said tucker member relative to said rotatable sheet material engagement member.

* * * * *